US005765872A

United States Patent [19]

Brügmann

[11] Patent Number: 5,765,872

[45] Date of Patent: Jun. 16, 1998

[54] SAMPLE BOOK BACK

[75] Inventor: Dirk A. Brügmann, Schwerte, Germany

[73] Assignee: Dirk A. Brugmann Kunststoff-Verarbeitung GmbH & Co. KG, Hagen, Germany

[21] Appl. No.: 717,254

[22] Filed: Sep. 20, 1996

[30] Foreign Application Priority Data

Sep. 20, 1995 [DE] Germany ..... 195 34 964.4

[51] Int. Cl.[6] ..... B42D 1/00

[52] U.S. Cl. ..... 281/21.1

[58] Field of Search ..... 281/21.1, 28, 45, 281/15.1; 190/16; 462/71; 24/341; 206/451; 412/34

[56] References Cited

U.S. PATENT DOCUMENTS

| | | | |
|---|---|---|---|
| 3,467,479 | 9/1969 | Holes et al. | 402/79 |
| 4,512,035 | 4/1985 | Brezowsky | 412/34 |
| 4,524,991 | 6/1985 | Thomas | 281/45 |
| 4,949,997 | 8/1990 | Champagne | 281/45 |

FOREIGN PATENT DOCUMENTS

| | | | |
|---|---|---|---|
| 2842625 | 4/1980 | Germany | 281/21.1 |
| 3245730 | 6/1984 | Germany | 281/45 |
| 7018415 | 6/1971 | Netherlands | 281/45 |

*Primary Examiner*—Daniel W. Howell
*Assistant Examiner*—Gregory Andoll
*Attorney, Agent, or Firm*—John F. A. Earley PC; John F. A. Earley, III

[57] ABSTRACT

The invention relates to a sample book back having at least two groups, which are disposed in such a way as to be spaced apart from one another, of retaining elements for holding laminar products in a detachable manner, the holding elements of each group being connected to one another in an articulating manner.

11 Claims, 7 Drawing Sheets

SAMPLE BOOK BACK

FIELD OF THE INVENTION

The invention relates to a sample book back. Sample books are known in various forms of embodiment and serve, among other things, for holding and displaying leather, carpetings, fabrics, foils, textile wall coverings or the like. To sum up, these products may be designated as goods in the form of foils or panels.

BACKGROUND OF THE INVENTION

As a rule, the sample book is set up in such a way that the products to be displayed are held in a detachable manner, so that it is possible to replace sample pieces when the collection is changed.

In its simplest embodiment, the sample book consists of a simple, so-called "book screw" which is guided through corresponding bores in the specimens and to the end of which a retaining loop is fastened. A sample book of this kind visually is not very attractive and has the disadvantage that the goods, which are disposed in alignment one above the other, always have to be folded back over the book screw and the carrying strap.

Another form of embodiment of a sample book is designed in such a way that the samples are disposed one above the other in a fanned-out manner. Accordingly, the lowest sample is the largest and each sample above it is somewhat shorter. At their opposite ends, which are disposed in alignment with one another, the samples are held together by a U-shaped rail, through which two screws are guided. A carrying handle serves to permit easy transport of the sample book. In this case, too, the individual samples have to be folded back over the back of the folder. This leads, after two, three or more samples have been folded back, to the latter tipping back again unless they are manually restrained.

There has therefore been no shortage of attempts to provide suitable book backs which permit, in a visually attractive manner, facilitated and improved holding and display of the specimens. These attempts include the proposal according to German Patent Specification 19 65 114. The specimens are fastened in retaining strips, and the latter have hinge sections which align with hinge sections of adjacent retaining strips and are connected to these in a detachable manner by a hinge pin. Although this proposal has brought an improvement in handling, it does not solve the problem of ensuring the folding-back of the goods by 180 degrees either. If for example, in the case of a sample book with 20 samples of carpeting, 10 are folded back, this leads, because of the retaining strips that obstruct each other, to the samples that have already been folded back tipping back again unless they are restrained. Another substantial disadvantage in that a sample book back of this kind has to be cut to size in situ in accordance with the specimens, so as not to have an excess length. This can lead to the hinge sections at the ends being so small that they break off during use.

SUMMARY OF THE INVENTION

The object of the invention is to make available a sample book back which overcomes the aforesaid disadvantages, that is to say, in particular, is of constructionally simple design, permits easy holding of the goods, permits the folding-back of individual specimens by approximately 180 degrees and can be adapted, in a problem-free manner, to the size of the particular specimens.

Taking the last part of the object as the starting point, the consideration from which the invention proceeds is—in contrast to the prior art—not to design the sample book back to be continuous (as one piece), such as is customarily the case even with any printed book, but to subdivide it into individual "book back sections", namely at least two. Each book back section then consists of a group of retaining (holding) elements for holding the laminar products (specimens) in a detachable manner, while the retaining elements of each group are connected to one another in an articulating manner.

The invention will be described below, purely by way of an example, with reference to a sample book for carpetings. For this purpose, for example, two groups of retaining elements are disposed at the upper and lower end of the left-hand edges of the samples carpeting. The holding and fixing of the carpenting samples will be described in still greater detail below.

Any kind of cutting-to-size is eliminated through the use of discrete book back sections. The groups of retaining elements are simply disposed where desired, regardless of the size of the samples. Even the number of samples has, to a great extent, no influence on the sample book back according to the invention, since the retaining elements are connected to one another in an articulating manner and there are combined together in groups, in the case of a sample book for 10 samples for example, 10 retaining elements and, in the case of a sample book for 20 samples, 20 such retaining elements. According to the invention, it is possible to increase or reduce the number of retaining elements per structural group at any desired time, that being another very substantial advantage.

For visual reasons, one form of embodiment of the invention provides that the groups of retaining elements are connected to one another by at least one profile strip disposed in a detachable manner. As will be described in still greater detail below, this profile strip may be in a single part or a number of pairs. It may be slipped, or fastened at that point, onto individual retaining elements or onto a whole group of retaining elements, but in the same way also onto the corresponding edge sections of the samples (specimens). Fastening to the samples is possible, according to the invention, because no continuous book back is used, but the latter consists of (at least two) individual sections, so that the samples "are uncovered" between the sections.

In a particular case, it may also be sufficient to cover exclusively the groups of retaining elements by at least one profile strip disposed in a detachable manner (and to correspondingly keep free the sections lying therebetween).

The said profile strips may, for example, be slipped or pushed onto the retaining elements by a corresponding construction (profiling) of the latter. This should also, if at all possible, take place in a detachable manner in order to permit the increase/reduction or other use of the retaining elements at any time.

Thus, it is easily possible, for examples, for two groups of retaining elements, which have been utilised for holding samples of carpeting of 0.5 $m^2$ in size, to be later used for holding wallpaper samples in the DIN A4 format, in which case the distance between the two groups is merely reduced and any cover/profile strips are shortened.

The articulating connection of the retaining elements to one another can be achieved in various ways, the emphasis being on the object of permitting folding-back by approximately 180 degrees.

A first form of embodiment provides that the retaining elements of a group have, for the purpose of articulating connection to an adjacent retaining element, an extension part which is connected, via an articulating part, to their base part which extension part can be secured in position in a corresponding recess in the base part of the adjacent retaining element.

In other words: Each retaining element consists of a (fixed) base part and a (fixed) extension part. The two are connected to one another in an articulating manner and the extension part of one retaining element is provided for notching engagement in the base part of an adjacent retaining element. In this way, two adjacent retaining elements can be connected (and also, optionally, detached again). At the same time it is ensured, via the joint disposed on the first retaining part, that the two parts can be tilted in relation to one another. The securing in position of adjacent retaining elements can take place parallel to the plane of the laminar products to be held, or perpendicularly thereto, without departing from the above basic technique for the connection of adjacent retaining elements.

It might also be possible, as an alternative, to connect adjacent retaining elements to one another via an articulating part, in which case the articulating part can be secured in position, by its vanes which extend on both sides of a joint, in corresponding recesses in the retaining elements.

Whereas, in the form of embodiment initially mentioned, the joint is an integral component of a retaining element (and the base part and extension part can accordingly be in one piece), the second form of embodiment is characterised by the use of a separate articulating part.

A form of joint which is particularly simple (from the production engineering viewpoint), but also technically favourable, consists in the construction of the joint as a film hinge. In this case, a single-part (material-locking) form of embodiment is possible in the case of the form of embodiment initially mentioned, having a base and extension part.

The following representation of various exemplified embodiments shows that the invention can be implemented in numerous constructional forms of embodiment. These include construction the retaining elements in such a way that they possess pocket-like receptacles which are open towards three directions and in which corresponding specimens (laminar products) can be secured in position. These can be clamped in, or notched in, in the retaining elements. If they are clamped in, a section of the said receptacles is preferably subjected to pre-tensioning. If they are notched in, there may protrude, from one inner face of a sidewall of said receptacle, at least one notching hook which notches into (a) corresponding opening(s) in the sample goods as soon as the latter are guided into the pocket receptacle.

The said retaining elements can be manufactured in a simple and economical manner as injection-moulded parts. The retaining elements may be in one piece, particularly in the form of embodiment having an integral articulating part. If the articulating part is constructed as a film hinge, for example, the entire retaining element is in one piece and the base part and extension part are connected to one another in a material-locking manner, that is to say, only a single material is needed, even to put together a whole group of retaining elements. At the same time, the design described permits the folding-back of individual samples, or of a number of samples, around the said articulating parts by 180 degrees, so that the sample book is particularly easy to handle.

Further features of the invention will emerge from the features in the sub-claims and also from the other application documents.

The invention will be explained in greater detail below with the aid of various exemplified embodiments. Under these circumstances, the following are shown in the figures—in schematized representation in each case:

DESCRIPTION OF PREFERRED EMBODIMENTS

Figure 1:
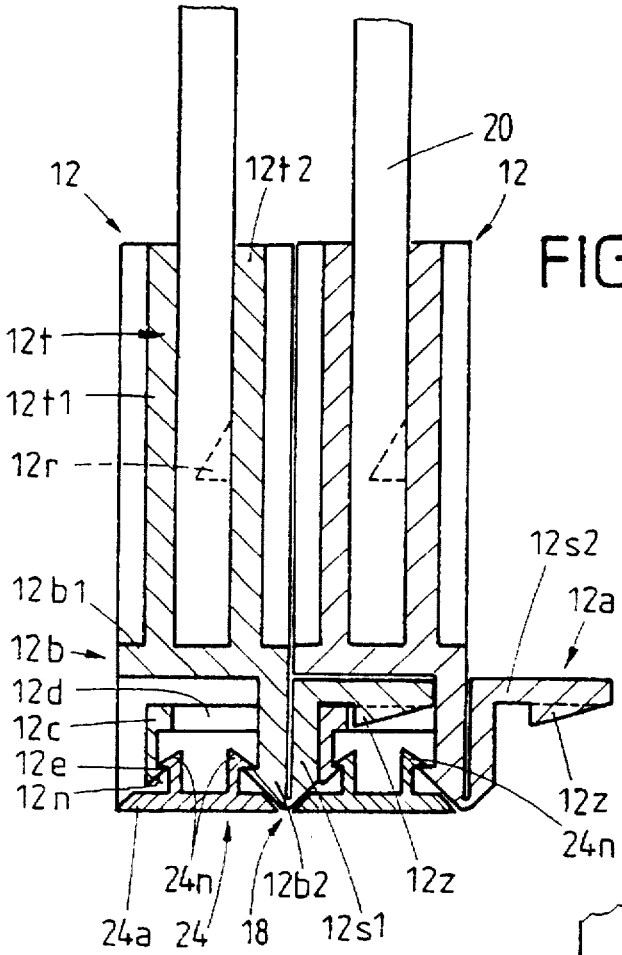
FIG. 1: a section through a first form of embodiment of a sample book back according to the invention.

FIG. 1 shows, in schematized form, a sample book back according to the invention, with laminar (flat) specimens inserted. The book back consists of three groups 10*a*, 10*b*, 10*c* of retaining elements 12, each group 10*a–c* comprising, in this case, six retaining elements 12 which are connected to one another in an articulating manner.

Figure 7:
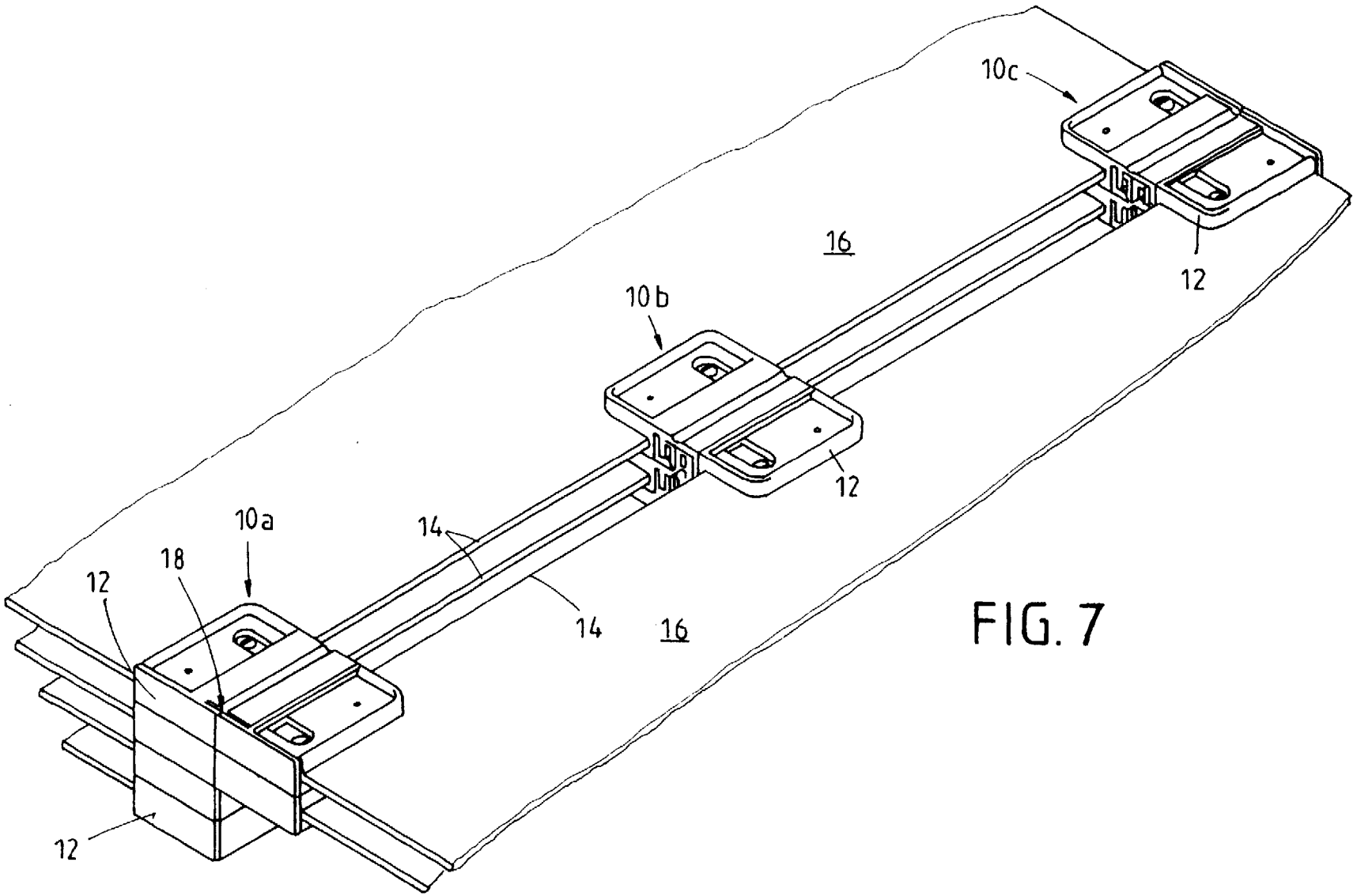
FIG. 7: a perspective partial view of an assembled sample book.

Whereas the groups 10*a* and 10*c* delimit, at the ends, the corresponding longitudinal edges 14 of specimens 16 which are inserted in the retaining elements 12 in a detachable manner, the group 10*b* extends approximately centrally, so that there are free spaces between the groups 10*a* and 10*b* and 10*b* and 10*c* respectively, so that the longitudinal edges 14 of the sample pieces 16 in FIG. 7 are visible at that point.

The set-up and design of the retaining elements 12 emerges from the rest of the figures. As shown in FIG. 1, the retaining element 12 consists of a base part 12*b*, an extension part 12*a* which is attached via a joint 18, and a pocket-shaped section 12*t* which belongs to the base part 12*b* and projects perpendicularly from the latter. The pocket-shaped section 12*t* consists of two plates 12*t*1 and 12*t*2, which extend parallel to one another. Projecting from the inner side of the plate 12*t*2 are notching noses 12*r* which engage in corresponding openings in a laminar sample piece 20 when the sample piece 20 is guided into the pocket 12*t*.

The rest of the base part 12*b* extends in an L-shaped manner (in section), the one sidepiece 12*b*1 carrying the pocket-shaped receptacle 12*t* and the other sidepiece 12*b*2 projecting perpendicularly from the sidepiece 12*b*1 oppositely to the plates 12*t*1 and 12*t*2.

Extending approximately centrally on the sidepiece 12*b*2, on the inner side, is an L-shaped arm 12*c*, the first section of which has perforations 12*d* and the free end 12*e* of which, like the free end of the sidepiece 12*b*2, has notching noses 12*n* which are directed inwards (towards one another).

Figure 5:
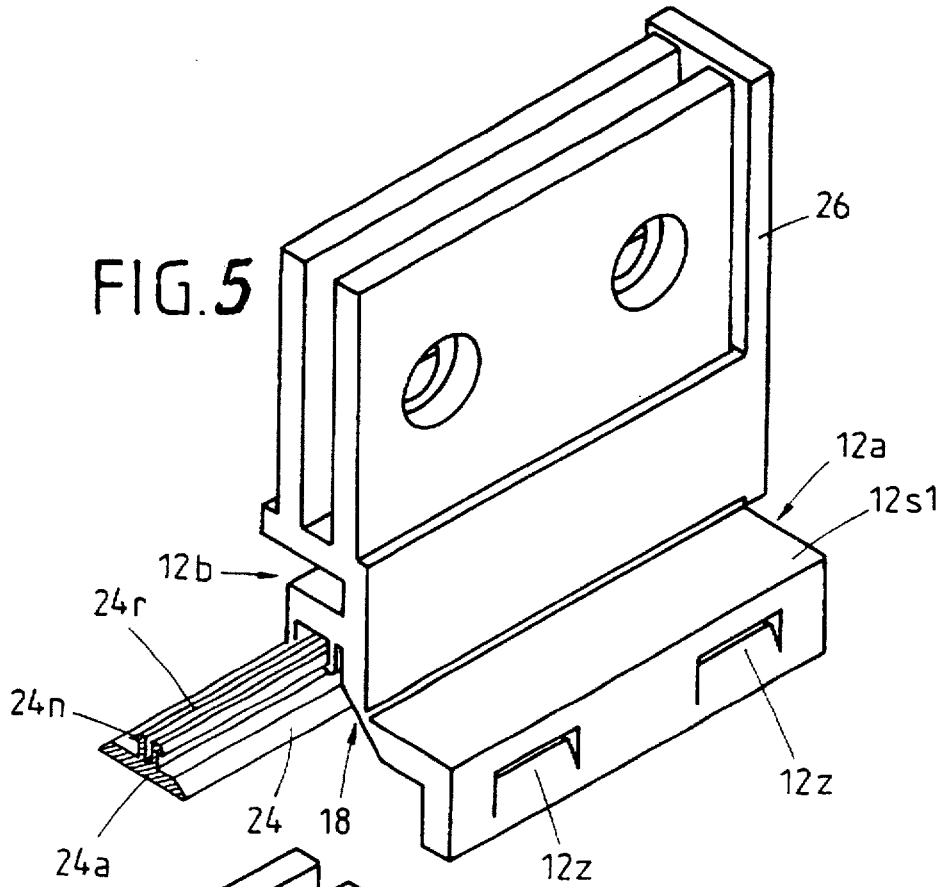
FIG. 5: a perspective view of a retaining element in accordance with the form of embodiment shown in FIG. 1.

Extending from the free end of the sidepiece 12*b*2, as shown by FIGS. 1 and 5, is an extension part 12*a* which likewise consists of a first sidepiece 12*s*1 and a second sidepiece 12*s*2 which is perpendicularly adjacent thereto. Whereas the first sidepiece 12*s*1 is connected, via a film hinge 18, to the sidepiece 12b2 in a material-locking manner, notching tongues 12z extend from the inner side of the sidepiece 12s2 in a manner corresponding to the openings 12d.

FIG. 1 shows the connection of two adjacent retaining elements 12, the extension part 12a on one retaining element being pushed into the base part 12b of the adjacent retaining element until the notching tongues 12z are notched into the corresponding openings 12d in the adjacent retaining element 12. On insertion, the run-up slopes of the notching tongues 12z first of all press the section 12c of the base part away, and spring back as soon as the tongues 12z are notched into the openings 12d.

In this way, any desired number of retaining elements 12 can be connected to one another in an articulating manner.

For visual reasons, the open sides of the retaining elements 12 are covered with profile strips 24 which consist, in each case, of a base rail 24a from which there project two notching strips 24r with outwardly jutting notching noses 24n which spring in behind the notching noses 12n on the retaining elements 12, when the profile strip 24 is pressed onto the open end of a retaining element 12. The outer shape of the profile strip 24 is adapted to the outer shape of the retaining element 12 in order to simulate a closed surface at the front end.

The sections extending perpendicularly thereto may also be constructed with a covering 26, as is diagrammatically indicated in FIG. 5.

Figure 2:
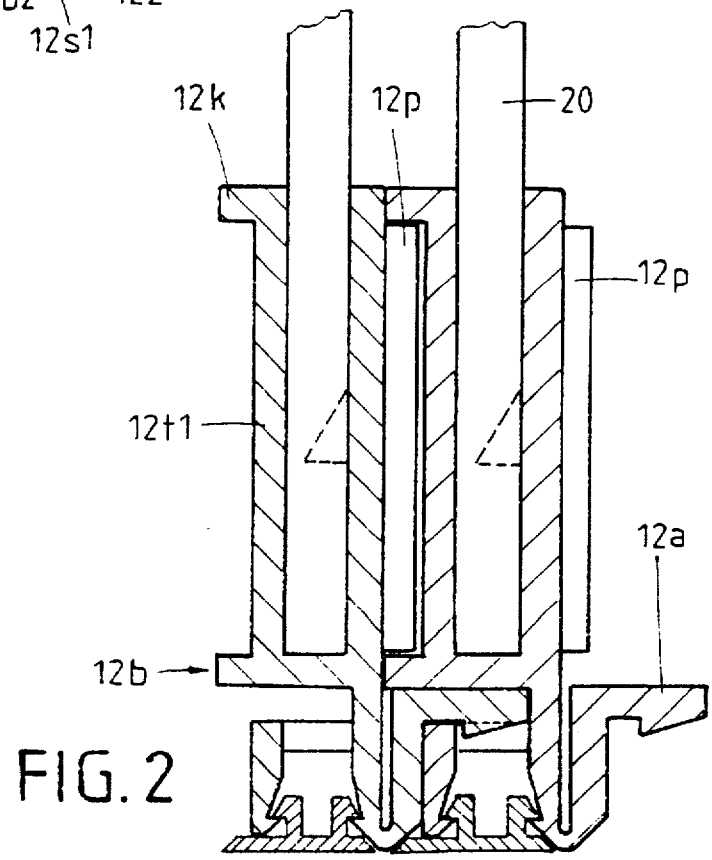
FIG. 2: a variation of the form of embodiment shown in FIG. 1.

The exemplified embodiment shown in FIG. 2 differs from that shown in FIG. 1 merely in that the plate-shaped part 12t1 has an angled portion 12k at its upper end (in the figure), whereas the section 12t2 is constructed on the outer side (on the right in FIG. 2) with a plate part 12p which is mounted on it and which can engage as a whole, for the purpose of increasing the stiffness of the book back, in the region between the angled portion 12k and the protruding end 12b1 of an adjacent retaining element, as is represented in FIG. 2.

Because of the construction of the joint 18 as a film hinge, it is easily possible, in all the forms of embodiment hitherto described, to fold back adjacent retaining elements 12 by 180 degrees, as is indicated diagrammatically in FIG. 7.

Figure 3:
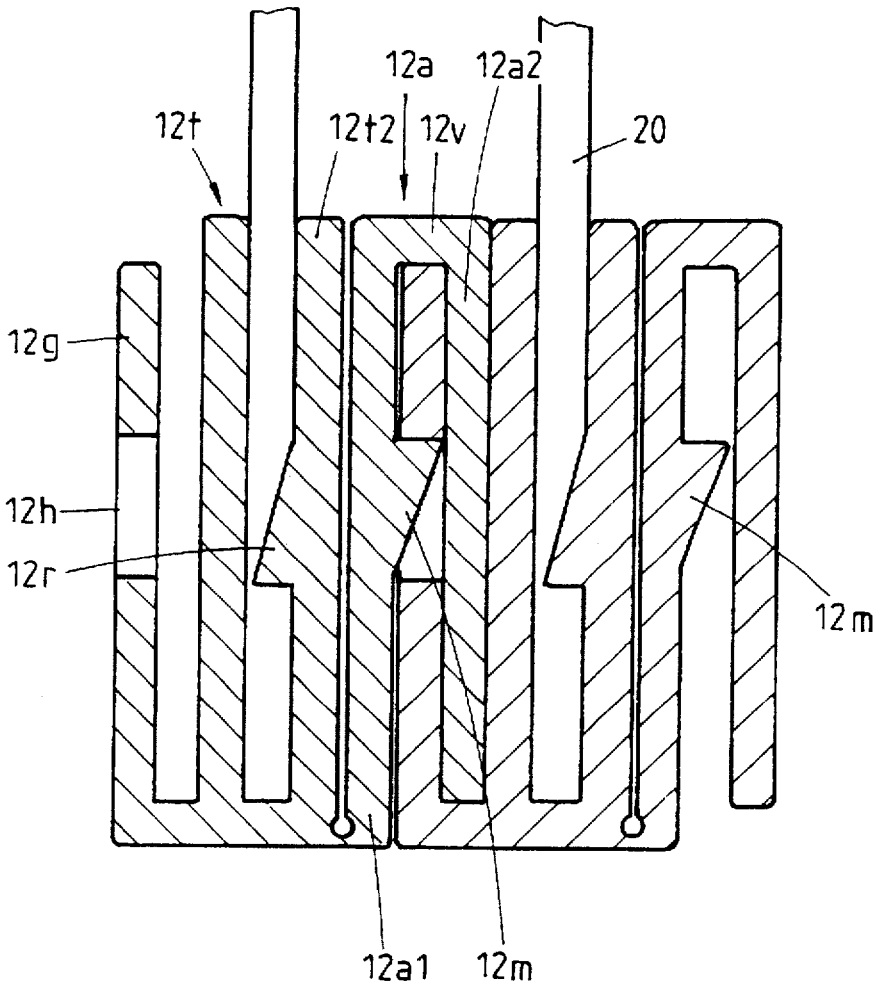
FIG. 3: a variation of the form of embodiment shown in FIG. 1.

The exemplified embodiment shown in FIG. 3 is similar to that shown in FIG. 1, but in this case adjacent retaining elements 12 are notchingly engaged, not perpendicularly to one another but parallel to one another.

For this purpose, a third plate-shaped arm 12g, with openings 12h which are constructed in a manner corresponding to the notching noses 12r on the wall 12t2, extends alongside the pocket-shaped holder 12t.

The extension part 12a consists of a first section 12a1 which, in the position illustrated in FIG. 3, extends parallel to the section 12t2 and merges, via a rectangularly attached connecting part 12v, into another arm 12a2 which is disposed parallel to the arm 12a1 and is of shorter construction than the latter. Extending from the inner side of the arm 12a1 are notching knobs 12m, the run-up slope of which is designed to be offset by 180 degrees in relation to the run-up slope of the notching hooks 12r.

For the purpose of connecting adjacent retaining elements 12, the section 12g of one retaining element is pushed into the region between the sections 12a1 and 12a2 of an adjacent retaining element, until the notching knobs 12m are snapped into the corresponding openings 12h and secure adjacent retaining elements in position. The fixing of the sample pieces 20 takes place in the manner previously described.

In this exemplified embodiment, too, the retaining element 12 is a single-part one. The articulating section 18 is, once again, designed according to a film hinge.

Figure 4:
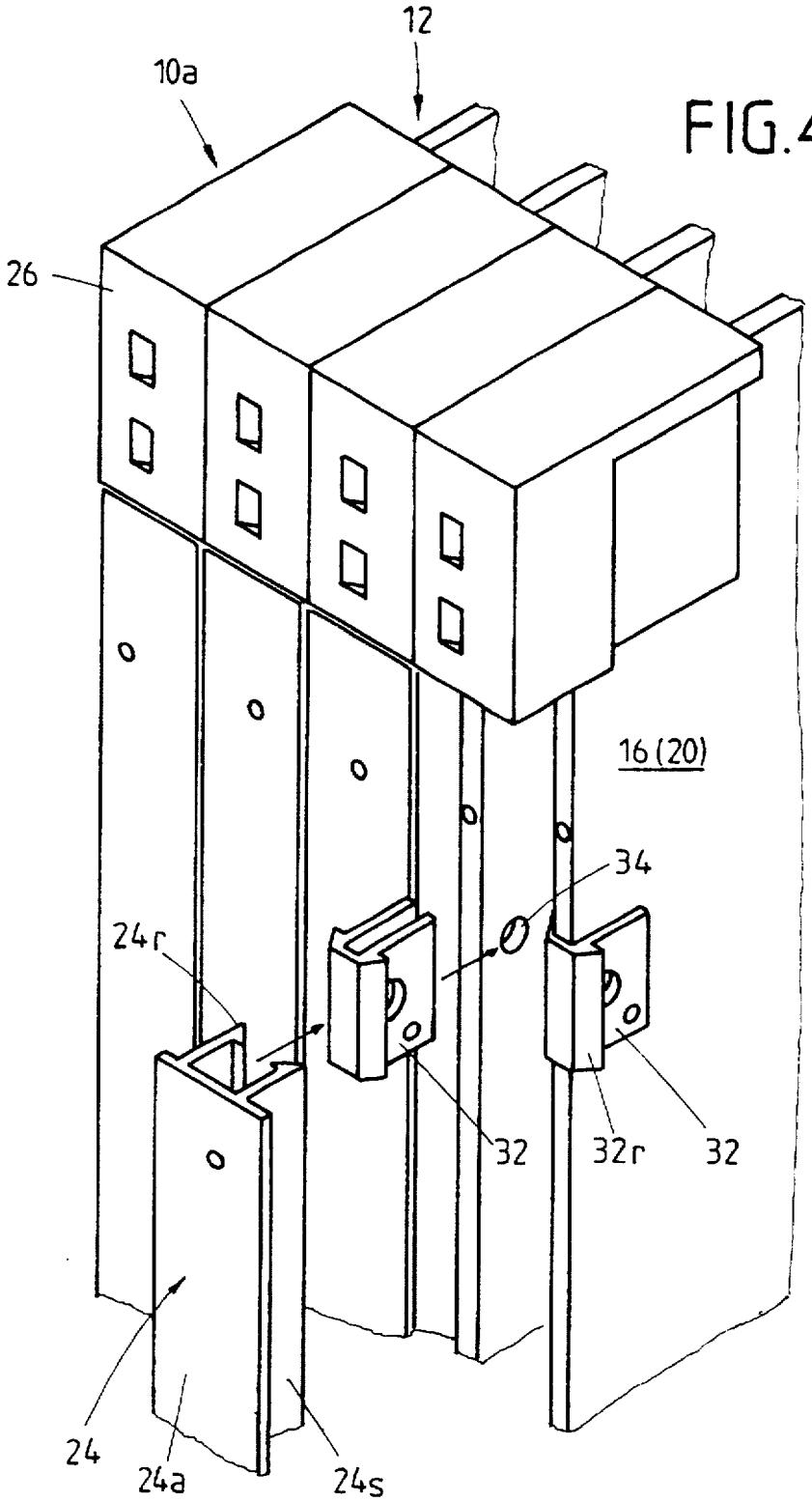
FIG. 4: a perspective view of a sample back.

FIG. 4 shows a perspective view of a book back with a first group 10a of retaining elements 12 which are covered, in each case, with a cap 26.

Clip-like fastening means 32 are mounted, in such a way as to be spaced apart from one another, on the longitudinal edges 14 of the sample pieces 16 (20). For this purpose, the sample pieces 16 (20) are constructed with hole systems 34 into which corresponding notching noses on the clips 32 notch, when the latter are mounted on the sample pieces 16 (20).

In the region of the longitudinal edges 14, the clips 32 are constructed with notching tongues 32r which extend on both sides and on which there can be mounted a profile strip 24 which connects together a number of clips 32 disposed on one longitudinal edge 14, and thus forms a continuous back covering. To this end, the profile strip 24 possesses two sidepieces 24s which are disposed at an interval from one another and have, at the ends, inwardly offset notching tongues 24r which, when mounted on the clips 32, spring behind the notching elements 32r and secure the profile strips 24 in position on the clips 32.

Figure 6:
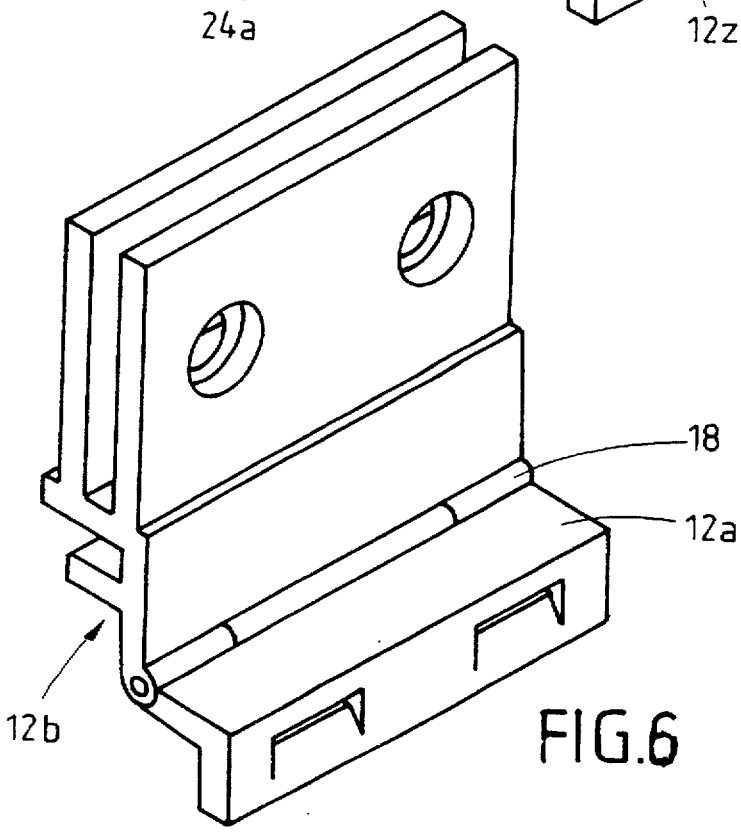
FIG. 6: a perspective view of another form of embodiment of a retaining element.

FIG. 6 finally shows an alternative form of embodiment of a joint 18 between the base part 12b and the extension part 12a of a retaining element 12, the joint 18 being, in this case, designed in a manner analogous to the joint according to German Patent 19 65 114. There is an essential difference, however, in so far as the joint 18 is, in this case, constructed in the region of a discrete retaining element 12, whereas in the prior art it extends continuously over the entire book back. This leads to the advantage, in the form of embodiment according to the invention, that no adaptation of the retaining elements 12, or of the joint 18, to the particular size of the sample book is necessary, since the individual retaining elements 12, or groups 10a–c of retaining elements 12, are disposed in such a way as to be spaced apart from one another, the distance of the groups 10a–c from one another being orientated by the dimensions of the appertaining sample book.

Figure 8:
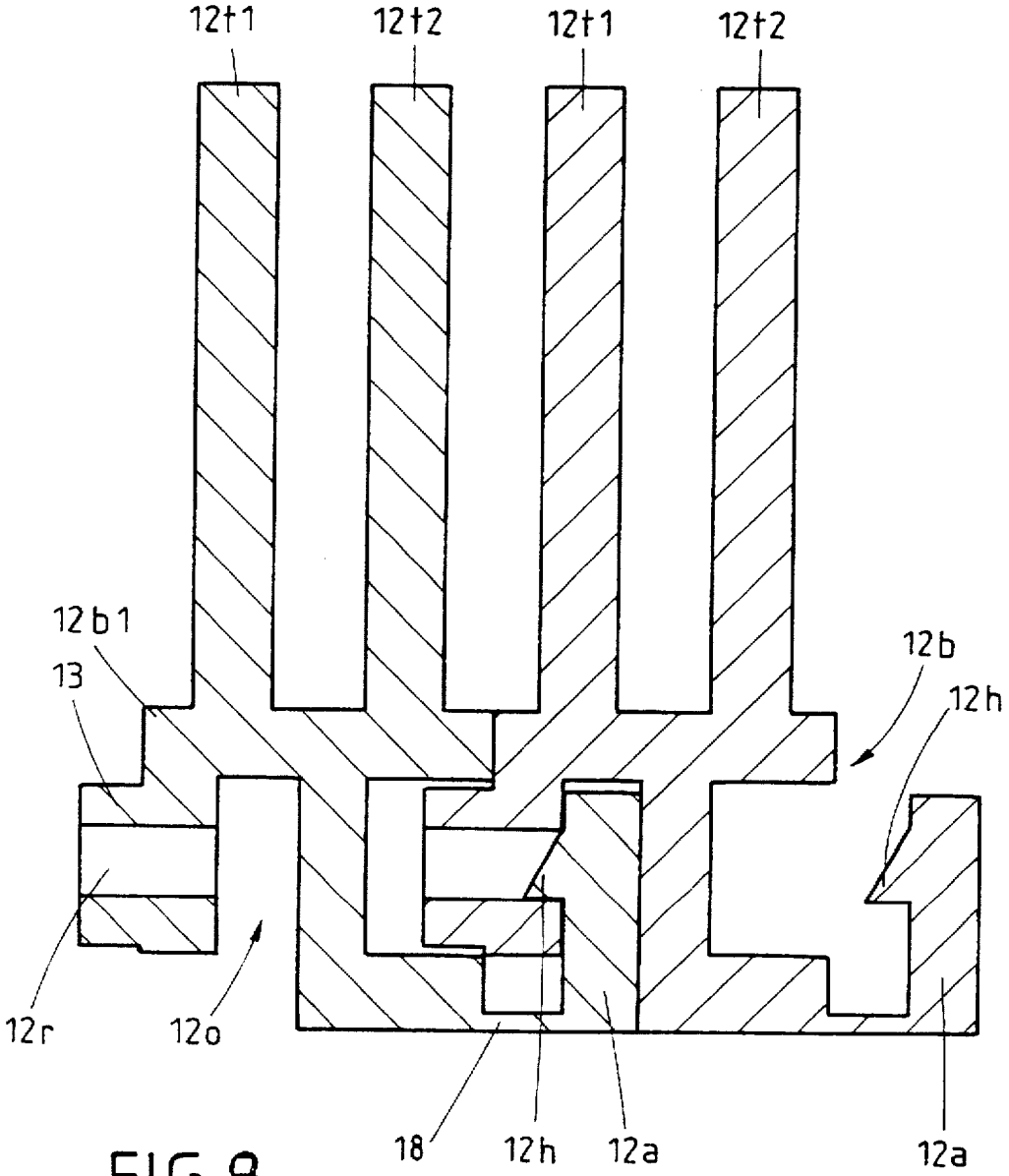
FIG. 8: a section through another form of embodiment of a sample book back.

FIG. 8 shows a section through two retaining elements 12 which are fitted into tone another and have, in each case, a base part 12b and an extension part 12a. The base part is once again formed, inter alia, by a pocket-shaped section 12t which consists of two plates 12t1, 12t2 which extend parallel to, and at a distance from, one another.

Extending from the sidepiece 12b1 connecting the plates 12t1, 12t2 is a rail-like region 13 which has a number of notching openings 12r which are disposed in such a way as to be spaced apart from one another and extend perpendicularly to the pocket 12t and which open, in the direction of the extension part 12a, into a receptacle opening 12o which extends parallel to the pocket 12t. The opposite wall of the holding opening 12o is bent over in an l-shaped manner at the bottom and merges, via an articulating connection, in this case a film hinge 18, into the extension part 12a, the latter being, once again, of rail-like design and having a number of notching hooks 12h which are disposed in such a way as to be spaced apart from one another and are disposed in a manner corresponding to the notching openings 12r in the base part 12b.

Figure 9:
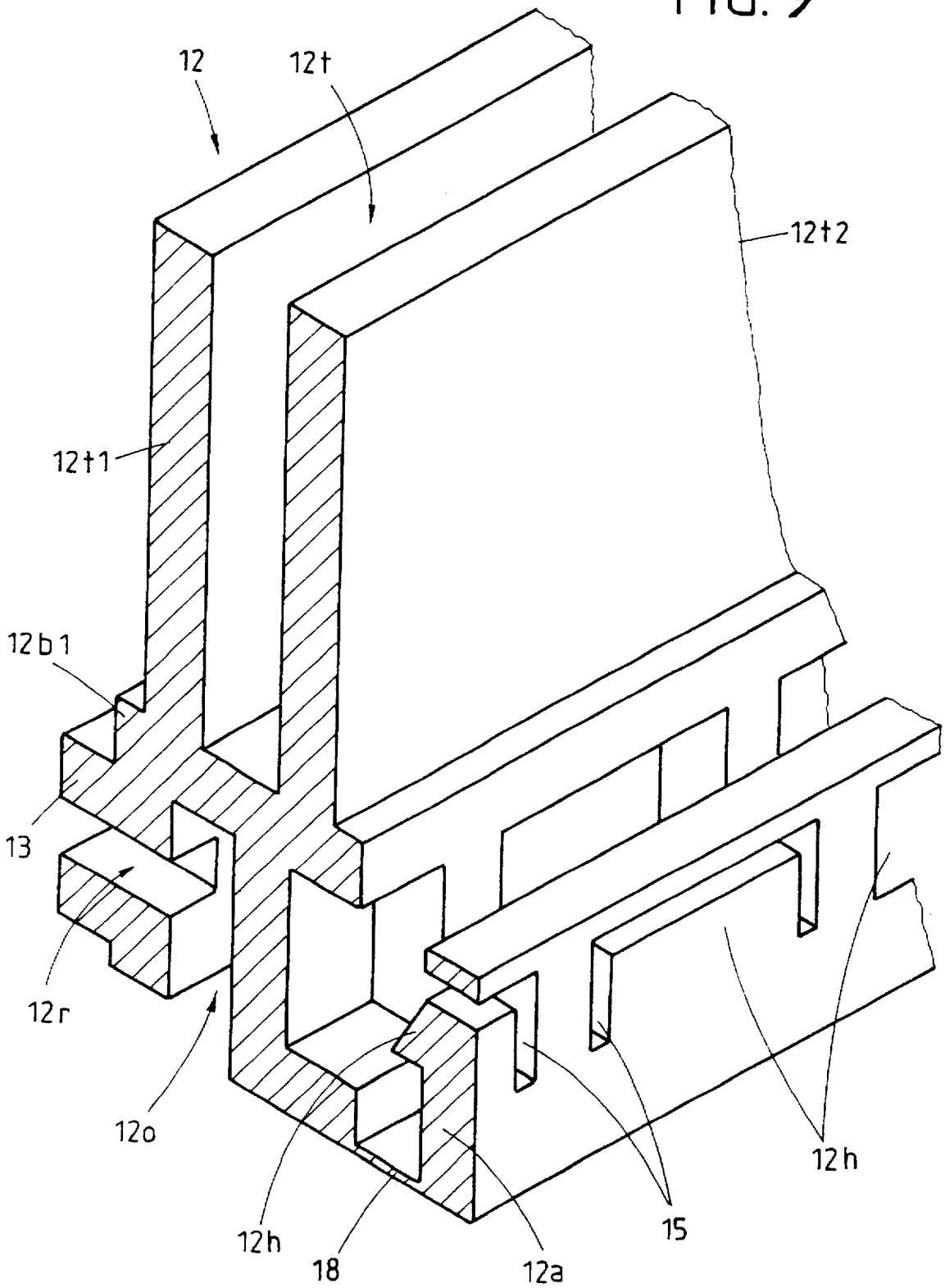
FIG. 9: the example shown in FIG. 8, in perspective.

In this instance, the notching hooks 12h are of resilient construction, in that their rim region is cut out on three sides, as can be inferred from FIG. 9 (cut-in portions 15).

FIG. 8 shows two adjacent retaining elements in the assembled condition, in which the extension part 12a on one retaining element 12 is notched, by means of its notching noses 12*h*, into the notching openings 12*r* in a base part of an adjacent retaining element 12, under which circumstances a parallel alignment of the extension part 12*a* and pocket 12*t* comes about when the book back is in the closed condition, which is illustrated here. The arrangement described makes it possible for the entire mechanical loading in the connecting region to be absorbed by the base part 12*b*, so that the film hinge 18 is relieved of load, mechanically speaking.

The dimensioning of the retaining elements 12 is such that, with the book back in the closed position (FIG. 8), the base sidepieces 12*b*1 of adjacent retaining elements 12 abut against one another in a laminar manner.

A plurality of retaining elements can be assembled side by side, in the manner represented in FIG. 8, in order to form a group of retaining elements.

I claim:

1. Sample book back comprising at least two groups (10*a–c*) of retaining elements (12) for holding laminar products (16, 20) in a detachable manner, wherein said groups (10*a–c*) of retaining elements (12) are disposed in such a way as to be spaced apart from one another, in which the retaining elements (12) of one group (10*a–c*) comprise, for purposes of connection to an adjacent retaining element (12), an extension part (12*a*) which is connected, via an articulating part (18), to their base part (12*b*), and which can be secured in position by notching engagement in a corresponding receptacle in a base part (12*b*) of the adjacent retaining element (12), and in which the extension part (12*a*) is designed in such a way that it runs, when the book back is closed, parallel to a pocket (12*t*), which holds the sample, in the corresponding receptacle in the base part (12*b*) of the adjacent retaining element (12).

2. Sample book back according to claim 1, in which the groups (10*a–c*) of retaining elements (12) can be connected to one another by at least one profile strip (24) which is disposed in a detachable manner.

3. Sample book back according to claim 1, in which the groups (10*a–c*) of retaining elements (12) can be covered by at least one profile strip (26) which is disposed in a detachable manner.

4. Sample book back according to claim 1, in which a profile strip (24) is constructed so as to be capable of being slipped or pushed onto the retaining elements (12).

5. Sample book back according to claim 1, including means for attaching adjacent retaining elements (12) in position in one another, parallel to the plane of the laminar products (16, 20) to be held.

6. Sample book back according to claim 1, including means for attaching adjacent retaining elements (12) in position in one another, perpendicularly to the plane of the laminar products (16, 20) to be held.

7. Sample book back according to claim 1, in which the retaining elements (12) of each group (10*a–c*) are connected to one another by a film hinge.

8. Sample book back according to claim 1, in which the extension part (12*a*) of a retaining element (12) can be connected, in a form-locking manner, to the base part (12*b*) of an adjacent retaining element (12).

9. Sample book back according to claim 1, in which the base part (12*b*) of a retaining element (12) has a receptacle opening (12*o*) extending parallel to the pocket (12*t*), and also at least one notching opening (12*r*), which projects perpendicularly from the receptacle opening (12*o*), for holding the extension part (12*a*) in a form-locking manner, and also notching hooks (12*h*) projecting from the extension part (12*a*).

10. Sample book back according to claim 1, in which the retaining elements (12) possess pocket-like holders (12*t*) which are open towards three sides and in which the appertaining laminar products (16, 20) can be secured in position.

11. Sample book back according to claim 1, in which the retaining elements (12) are injection moulded.

* * * * *